US010153568B2

(12) United States Patent
Goto

(10) Patent No.: US 10,153,568 B2
(45) Date of Patent: Dec. 11, 2018

(54) PRESS-FIT TERMINAL AND MANUFACTURING METHOD FOR SAME

(71) Applicant: Sumitomo Wiring Systems, Ltd., Yokkaichi, Mie (JP)

(72) Inventor: Hideki Goto, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/808,160

(22) Filed: Nov. 9, 2017

(65) Prior Publication Data

US 2018/0138610 A1 May 17, 2018

(30) Foreign Application Priority Data

Nov. 17, 2016 (JP) ..... 2016-224474

(51) Int. Cl.
*H01R 12/58* (2011.01)
*H01R 43/16* (2006.01)

(52) U.S. Cl.
CPC ..... *H01R 12/585* (2013.01); *H01R 43/16* (2013.01)

(58) Field of Classification Search
CPC .. H01R 12/585; H01R 43/16; H01R 13/2457; H01R 9/091; H01R 13/41
USPC ..... 439/825, 82, 751, 872–873
See application file for complete search history.

(56) References Cited

U.S. PATENT DOCUMENTS 4,186,982 A * 2/1980 Cobaugh ..... H01R 12/58 439/444
5,055,072 A * 10/1991 Shinoda ..... H01R 12/58 439/751
5,115,375 A * 5/1992 Garay ..... H05K 7/142 361/760
5,509,814 A * 4/1996 Mosquera ..... H01R 12/58 439/78
2004/0145880 A1 7/2004 Watanabe et al.
2006/0246786 A1* 11/2006 Noguchi ..... H01R 12/585 439/751
2017/0310027 A1* 10/2017 Goto ..... H01R 12/585
2017/0346202 A1* 11/2017 Goto ..... H01R 13/2457

FOREIGN PATENT DOCUMENTS

JP 2004-127610 A 4/2004
JP 2016-027536 A 2/2016

* cited by examiner

*Primary Examiner* — Edwin A. Leon
(74) *Attorney, Agent, or Firm* — Honigman Miller Schwartz and Cohn LLP

(57) ABSTRACT

A press-fit terminal and a manufacturing method for the same that enable plating on the surface of a pressure contact part to be in a stable state is provided. A first pressing part on a lateral edge apart from a slit and a first raised part projects further on one side than the first pressing part between the slit and the first pressing part are provided in a central portion of a first elastic pressure contact piece, with a pressure contact part being the first raised part, and a second pressing part 36 on a lateral edge apart from the slit and a second raised part that projects further on the other side than the second pressing part between the slit and the second pressing part are provided in a central portion of a second elastic pressure contact piece, with a pressure contact part being the second raised part.

2 Claims, 12 Drawing Sheets

PRESS-FIT TERMINAL AND MANUFACTURING METHOD FOR SAME

CROSS-REFERENCE TO RELATED APPLICATIONS

This application claims priority of Japanese Patent Application No. JP2016-224474 filed Nov. 17, 2016.

TECHNICAL FIELD

The present invention relates to a press-fit terminal provided with a pressure contact part that, by being press-fitted into a through hole of a printed circuit board, is electrically connected through pressure contact to a conductor formed on the inner surface of the through hole, and to a manufacturing method for the same.

BACKGROUND

Press-fit terminals that are press-fitted for use into through holes of printed circuit boards are conventionally known, and, as described in JP 2004-127610A, for example, are provided with a pressure contact part having springiness on one end side of a terminal fitting that is plated after being punched out from a metal plate and with a connection part configured to be connected to a partner side member on the other end of the terminal fitting. By then press-fitting the pressure contact part into a through hole of a circuit board, the pressure contact part is electrically connected through pressure contact to a conductor exposed inside the through hole.

Incidentally, as also described in JP 2004-127610A, the press-fit terminal is formed by post-plating a press-cut surface constituting the pressure contact part after press punching a metal plate. On the one end side of the terminal fitting, an open hole is then punched out in a central portion to form a pair of arch-shaped pressure contact parts, and springiness is provided by the pair of pressure contact parts being made elastically deformable in the plate width direction.

However, given that it is difficult to secure sufficient flexure with a pair of pressure contact parts that are made arch-shaped by punching out an open hole in a central portion, increasing the insertion force of the pressure contact parts on the through hole is unavoidable, and runs the risk of the pressure contact parts scraping the inner surface of the through hole and producing metal filings. Also, given that the pair of arch-shaped pressure contact parts are formed by punching out an open hole in a central portion, a press-fit terminal having this shape cannot be easily constituted using a very narrow terminal fitting, and it is difficult to cope with the increasing densification of printed circuit boards. Furthermore, given that the pressure contact parts are constituted by the press-cut surface formed at the time of the press punching process, post-plating is essential, resulting in an unavoidable increase in costs.

In view of this, the inventor proposed a press-fit terminal in which the pressure contact parts are formed using the plating surface of a metal plate by forming a slit that extends in the length direction in a central portion of the pressure contact parts, and causing both sides of this slit to project on opposite sides to each other, as initially shown in FIG. 15 of JP 2016-27536A. According to this press-fit terminal, given that springiness is provided by making the pressure contact parts readily elastically deformable in the plate thickness direction, the insertion force of the pressure contact parts on the through hole can be reduced, and the problem of the pressure contact parts scraping the inner surface of the through hole can also be reduced, compared with the case where the pressure contact parts are elastically deformable in the plate width direction. Also, given that the pressure contact parts are formed by a slit that extends in the length direction through a central portion of the terminal, a press-fit terminal having the above shape can also be constituted using a very narrow terminal fitting, and it also becomes possible to cope with the increasing densification of printed circuit boards. Furthermore, given that the pressure contact parts are not constituted by a press-cut surface formed at the time of a press punching process, post-plating is not required, enabling costs to be reduced.

However, even though the pressure contact parts are not constituted by a press-cut surface formed at the time of a press punching process, it is conceivable that the plating on the surface of the pressure contact parts could possibly be damaged at the time of providing the slit when forming this press-fit terminal using a terminal fitting having an even smaller width dimension. Hence, there is still room for improvement, and further development on an improved press-fit terminal has been progressing.

JP 2004-127610A and JP 2016-27536A are examples of related art.

SUMMARY

The present invention was made in view of the above-mentioned situation, and it is thus an object of the present invention to provide a press-fit terminal having a novel structure and a manufacturing method for the same that enable plating on the surface of a pressure contact part to be left in a very stable state.

To solve the above-described problem, a first aspect of the present invention relating to a press-fit terminal in which a pressure contact part configured to be press-fitted into a through hole of a printed circuit board and connected through pressure contact to a conductor on an inside surface of the through hole is provided on one end side of a terminal fitting cut out from a metal plate that has been surface plated in advance, and in which a slit that passes through a central portion in a plate width direction of the terminal fitting and a first elastic pressure contact piece and a second elastic pressure contact piece that are separated on both sides in the plate width direction by the slit are provided in a lengthwise central portion on the one end side of the terminal fitting, a lengthwise central portion of the first elastic pressure contact piece being deformed to project on one side in a plate thickness direction of the terminal fitting and a lengthwise central portion of the second elastic pressure contact piece being deformed to project on an other side in the plate thickness direction of the terminal fitting is characterized that in the press-fit terminal includes, in the lengthwise central portion of the first elastic pressure contact piece, a first pressing part that is provided on a lateral edge part side located apart from the slit in a plate width direction of the first elastic pressure contact piece and a first raised part that is located between the slit and the first pressing part and projects further on the one side in the plate thickness direction than the first pressing part, the pressure contact part of the first elastic pressure contact piece being constituted by the first raised part, and in the lengthwise central portion of the second elastic pressure contact piece, a second pressing part that is provided on a lateral edge part side located apart from the slit in a plate width direction of the second elastic pressure contact piece and a second raised part that is located between the slit and the second pressing part and projects further on the other side in the plate thickness direction than the second pressing part, the pressure contact part of the second elastic pressure contact piece being constituted by the second raised part.

According to this aspect, a first elastic pressure contact piece and a second elastic pressure contact piece that are separated by a slit and project on both sides in the plate thickness direction are provided on one end side of a terminal fitting that is cut out by press punching or the like from a metal plate that has been surface plated in advance. Furthermore, a pressing part provided on a lateral edge part side in the plate width direction of each elastic pressure contact piece and a raised part that is located between the slit and the pressing part and projects more outwardly in the plate thickness direction than the pressing part are provided in a lengthwise central portion that projects in the plate thickness direction in each elastic pressure contact piece, and a pressure contact part of each elastic pressure contact piece is constituted by this raised part. Hence, a configuration is adopted in which the raised part constituting the pressure contact part is located apart from the slit in the plate width direction, enabling the influence of plating damage caused by provision of the slit to be advantageously avoided. As a result, surface plating that is performed in advance on the metal plate can be left in a stable state on the surface of the pressure contact parts, enabling the stability of the electrical connection with the conductor in the through hole to be stably secured, and the need for post-plating on the pressure contact parts to also be more reliably eliminated.

A second aspect of the present invention relating to a press-fit terminal is characterized in that, in addition to the configuration disclosed in the first aspect, the first raised part and the second raised part have a curved outer peripheral shape.

According to this aspect, given that the first raised part and the second raised part that constitute the pressure contact parts have a curved outer peripheral shape, excessive contact resistance with the inner surface of the through hole when press-fitting the pressure contact parts into the through hole can be suppressed, enabling peeling of the plating or damage to the plating that remains on the surface of the first raised part and the second raised part to be further reduced, and a stable connection state to be advantageously maintained.

A first aspect of the present invention relating to a manufacturing method for a press-fit terminal in which a pressure contact part configured to be press-fitted into a through hole of a printed circuit board and connected through pressure contact to a conductor of an inner surface of the through hole is provided on one end side of a terminal fitting is characterized in that the method includes a first pressing part/raised part formation step of, where in a lengthwise central portion on one end side of a terminal fitting cutout target part from which the terminal fitting is to be cut out in a metal plate that has been surface plated in advance, a central portion in a plate width direction of the terminal fitting cutout target part is a slit formation target part, and both sides in the plate width direction that sandwich the slit formation target part therebetween are respectively a first elastic pressure contact piece formation target part and a second elastic pressure contact piece formation target part, providing, in a lengthwise central portion of the first elastic pressure contact piece formation target part on one surface in a plate thickness direction, a first pressing part by flattening a lateral edge part side located apart from the slit formation target part in a plate width direction of the first elastic pressure contact piece formation target part, and a first raised part that is raised due to the first pressing part to be located between the slit formation target part and the first pressing part, a second pressing part/raised part formation step of providing, in a lengthwise central portion of the second elastic pressure contact piece formation target part on an other surface in the plate thickness direction, a second pressing part by flattening a lateral edge part side located apart from the slit formation target part in a plate width direction of the second elastic pressure contact piece formation target part, and a second raised part that is raised due to the second pressing part to be located between the slit formation target part and the second pressing part, a terminal fitting cutout step of cutting out the terminal fitting from the terminal fitting cutout target part in the metal plate, after the first pressing part/raised part formation step and the second pressing part/raised part formation step, and a slit and elastic pressure contact piece formation step of forming, in the slit formation target part of the cut out terminal fitting, a slit that passes through in the plate thickness direction, forming the first elastic pressure contact piece by deforming a lengthwise central portion of the first elastic pressure contact piece formation target part to project on one side of the terminal fitting in the plate thickness direction and constituting the pressure contact part of the first elastic pressure contact piece by the first raised part, and forming the second elastic pressure contact piece by deforming a lengthwise central portion of the second elastic pressure contact piece formation target part to project on an other side of the terminal fitting in the plate thickness direction and constituting the pressure contact part of the second elastic pressure contact piece by the second raised part.

According to this aspect, steps of forming first/second pressing parts are implemented on first/second elastic pressure contact piece formation target parts on both sides of a slit formation target part, in a terminal fitting cutout target part from which a terminal fitting is to be cut out in a metal plate that has been surface plated in advance, and after cutting out the terminal fitting from the terminal fitting cutout target part of the metal plate by press punching or the like, a slit formation step is implemented on a different portion from the first/second raised parts. Hence, the step of forming first/second raised parts constituting the pressure contact parts can be performed in advance separately from the slit formation step, and first/second raised parts (pressure contact parts) on which surface plating performed in advance on the terminal fitting is stably extended can be constituted by avoiding plating damage caused by the slit formation step.

Moreover, in the subsequent slit formation step, given that the slit is provided in the slit formation target part located apart from the first/second raised parts in the plate width direction, the surface plating remaining on the first/second raised parts (pressure contact parts) being adversely affected by the slit formation step is advantageously avoided. As a result, a press-fit terminal can be advantageously manufactured in which surface plating that is performed on the metal plate in advance can be left in a stable state on the surface of the pressure contact parts, enabling the stability of the electrical connection with the conductor inside the through hole to be stably secured and the need to perform post-plating on the pressure contact parts to also be more reliably eliminated.

According to the present invention, a first elastic pressure contact piece and a second elastic pressure contact piece that are separated by a slit and project on both sides in the plate thickness direction are provided on one end side of the terminal fitting cut out by press punching or the like from a metal plate that has been surface plated in advance. Furthermore, a pressing part provided on the lateral edge part side and a raised part that is located between the slit and the pressing part and projects more outwardly in the plate thickness direction than the pressing part are provided in a central portion in the length direction that projects in the plate thickness direction in each elastic pressure contact piece, and the pressure contact part of each elastic pressure contact piece is constituted by the raised part. Hence, a configuration is adopted in which the raised parts constituting the pressure contact parts are located apart from the slit in the plate width direction, enabling the influence of plating damage caused by provision of the slit to be advantageously avoided. As a result, surface plating that is performed on the metal plate in advance can be left in a stable state on the surface of the pressure contact parts, enabling the stability of the electrical connection with the conductor inside the through hole to be stably secured, and the need for post-plating on the pressure contact parts to also be more reliably eliminated.

BRIEF DESCRIPTION OF THE DRAWINGS

FIG. 10(*b*) is a bottom view showing the result of a process of flattening a pressing part.

FIG. 12(*b*) is a view showing the result of a slit and elastic pressure contact piece formation process.

DETAILED DESCRIPTION OF PREFERRED EMBODIMENTS

Figure 1:
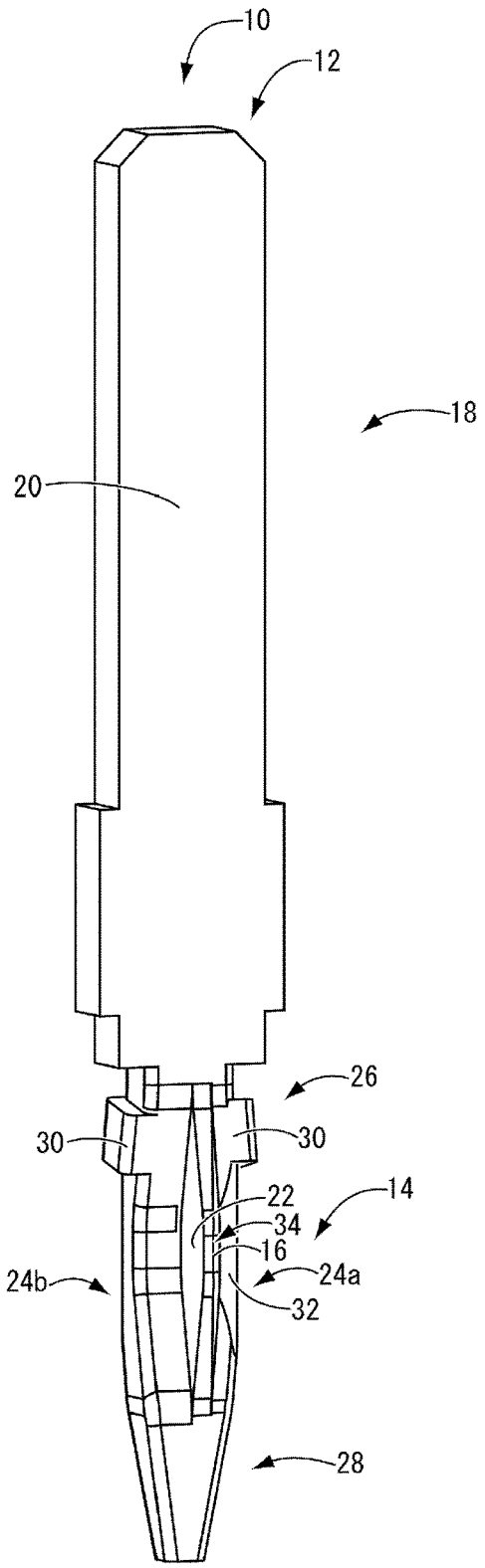
FIG. 1 is a perspective view showing a press-fit terminal serving as one embodiment of the present invention.

Hereinafter, embodiments of the present invention will be described, with reference to the drawings.

First, a press-fit terminal 10 serving as one embodiment of the present invention is shown in FIGS. 1 to 4. The press-fit terminal 10 is an integrally molded article provided with a pressure contact part 16 on one end side 14 (lower end side in FIGS. 1 to 4) of a terminal fitting 12, and in which a connection part 20 that is wider than the one end side 14 and is configured to be connected to a partner side member which is not illustrated is formed on an other end side 18 of the terminal fitting 12 (upper end side in FIGS. 1 to 3). Note that, in the following description, upward is upward in FIGS. 1 to 4, downward is downward in FIGS. 1 to 4, forward is leftward in FIG. 4, and rearward is rightward in FIG. 4, and also that the plate thickness direction is the left-right direction in FIG. 4, the plate width direction is the left-right direction in FIGS. 2 to 3, and the length direction is the up-down direction in FIGS. 1 to 4.

[The terminal fitting 12 has a plate-like shape, and is, for example, formed by a metal plate such as a copper plate whose surface has been plated in advance with tin or the like being cut out using a press punching process or the like. The pressure contact part 16 is provided on the one end side 14 of the terminal fitting 12 formed in this manner. More specifically, in a lengthwise central portion on the one end side 14 of the terminal fitting 12, a slit 22 that passes through, in the plate thickness direction (left-right direction in FIG. 4), a central portion in the plate width direction (left-right direction in FIGS. 2 to 3) of the terminal fitting 12 and extends in the length direction (up-down direction in FIGS. 2 to 3) of the terminal fitting 12, and a first elastic pressure contact piece 24*a* and a second elastic pressure contact piece 24*b* that are substantially strip-shaped in front view and are separated on both sides in the plate width direction by the slit 22 and extend in the length direction are provided. The first elastic pressure contact piece 24*a* and the second elastic pressure contact piece 24*b* are constituted by respective base end parts 26 and tip parts 28 being coupled together, and, moreover, the tip parts 28 have a tapered shape with a narrow tip. Also, as a result of a lengthwise central portion of the first elastic pressure contact piece 24*a* having such a configuration being deformed to project forward (leftward in FIG. 4) in the plate thickness direction of the terminal fitting 12 and a lengthwise central portion of the second elastic pressure contact piece 24*b* being deformed to project rearward (rightward in FIG. 4) in the plate thickness direction of the terminal fitting 12, pressure contact parts 16 are constituted by these lengthwise central portions. Also, in the respective base end parts 26 of the first elastic pressure contact piece 24*a* and the second elastic pressure contact piece 24*b*, stopping protrusions 30 are formed to project outwardly in the plate width direction (left-right direction in FIGS. 2 to 3) from both sides in the plate width direction by a substantially uniform amount.

Figure 2:
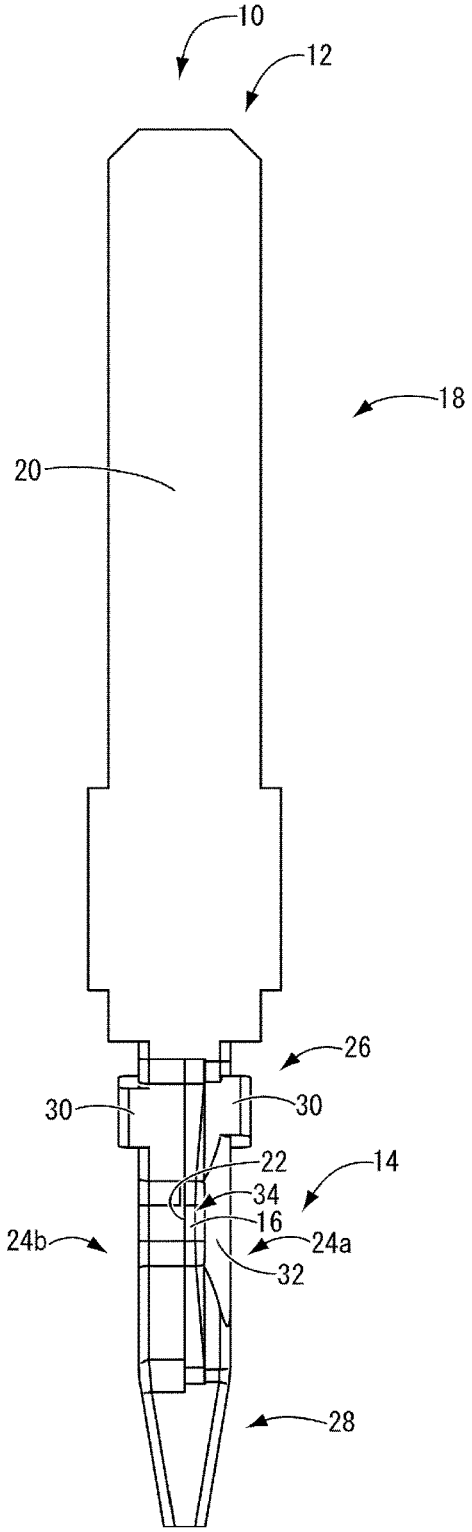
FIG. 2 is a front view of FIG. 1.

In addition, as shown in FIG. 1 and FIG. 2, in a lengthwise central portion of the first elastic pressure contact piece 24*a*, a first pressing part 32 (see FIG. 2) constituting a recessed part that has a substantially trapezoidal shape in front view and is provided on a lateral edge part side located apart from the slit 22 in the plate width direction of the first elastic pressure contact piece 24*a* and a first raised part 34 that has a substantially vertically long rectangular shape in front view and is located between the first pressing part 32 and the slit 22 and projects further on the frontward side (left side in FIG. 4) in the plate thickness direction than the first pressing part 32 are provided, and the pressure contact part 16 of the first elastic pressure contact piece 24*a* is constituted by this first raised part 34. Also, as shown in FIG. 4, the first raised part 34 is constituted to have a curved outer peripheral shape.

Figure 3:
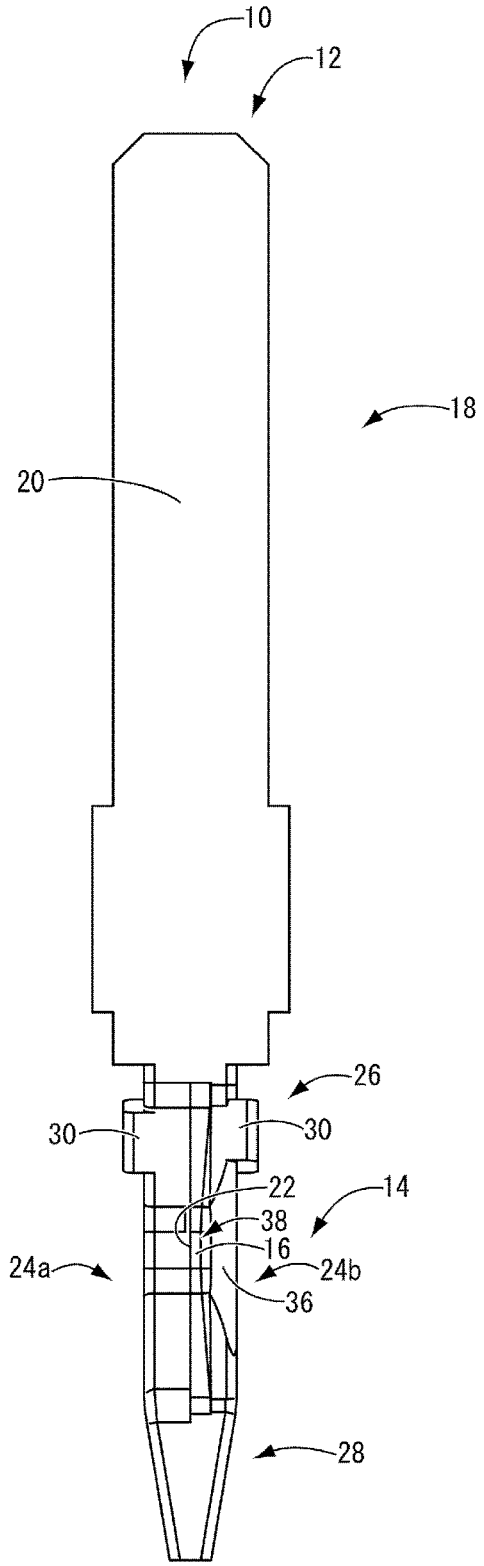
FIG. 3 is a rear view of FIG. 1.
Figure 4:
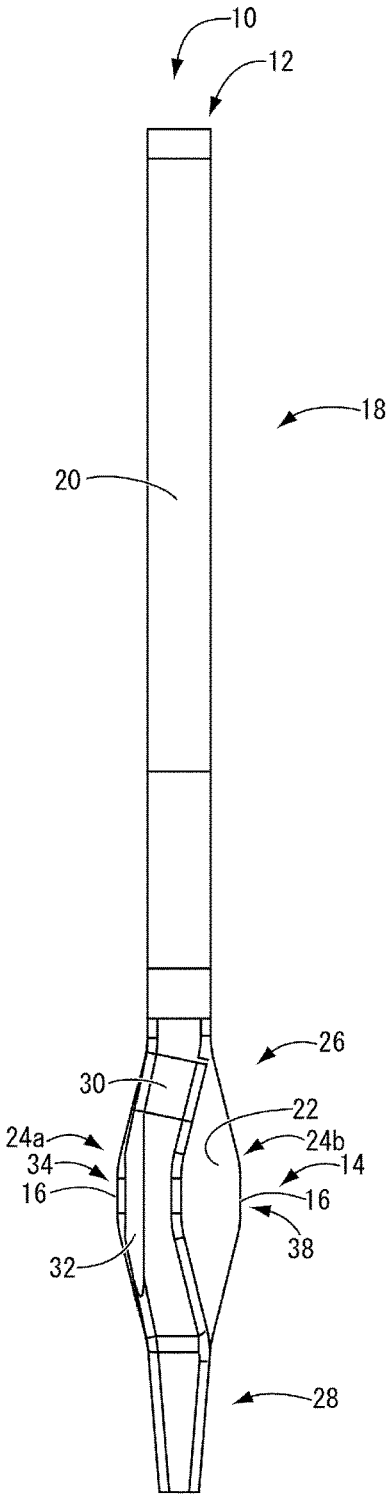
FIG. 4 is a right lateral view of FIG. 1.

Similarly, as shown in FIG. 3 and FIG. 4, in a lengthwise central portion of the second elastic pressure contact piece 24*b*, a second pressing part 36 (see FIG. 3) constituting a recessed part that has a substantially trapezoidal shape in front view and is provided on a lateral edge part side located apart from the slit 22 in the plate width direction of the second elastic pressure contact piece 24*b* and a second raised part 38 that has a substantially virtually long rectangular shape in front view and is located between the second pressing part 36 and the slit 22 and projects further on the rearward side (right side in FIG. 4) in the plate thickness direction than the second pressing part 36 are provided, and the pressure contact part 16 of the second elastic pressure contact piece 24*b* is constituted by this second raised part 38. Also, as shown in FIG. 4, the second raised part 38 is constituted to have a curved outer peripheral shape.

On the other hand, on the other end side 18 of the terminal fitting 12, the connection part 20 extending in a substantially strip shape in the length direction (up-down direction in FIGS. 2 to 3) of the terminal fitting 12 is provided. The tip part (upper end part in FIG. 1) of this connection part 20 has a narrow tapered shape.

Figure 7:
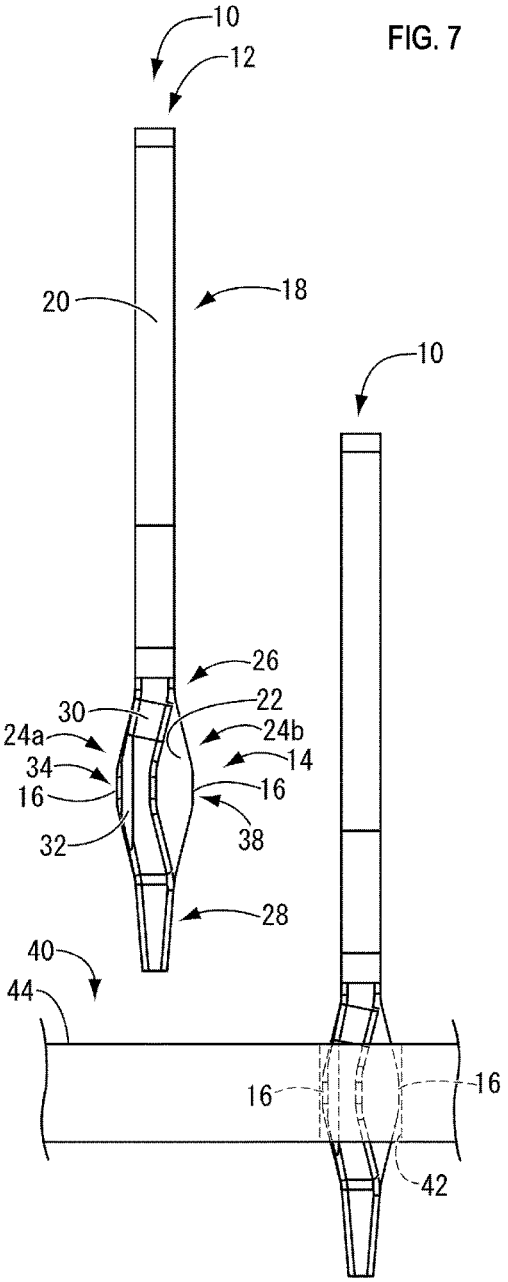
FIG. 7 is a right lateral view of FIG. 5.

The press-fit terminal 10 having such a structure is, as shown in FIGS. 5 to 8, inserted from the first elastic pressure contact piece 24*a* and the second elastic pressure contact piece 24*b* provided on the one end side 14 of the terminal fitting 12 into a through hole 42 of a printed circuit board 40. Given that the tip parts 28 of the first elastic pressure contact piece 24*a* and the second elastic pressure contact piece 24*b* have a tapered shape with a narrow tip, the task of inserting the press-fit terminal 10 into the through hole 42 can be performed stably and efficiently with the tip part 28 acting as a guide. When the press-fit terminal 10 is pushed further into the through hole 42, insertion of the first elastic pressure contact piece 24*a* and the second elastic pressure contact piece 24*b* into the through hole 42 is permitted, as a result of the lengthwise central portions of the first elastic pressure contact piece 24*a* and the second elastic pressure contact piece 24*b* being elastically deformed inwardly in the plate thickness direction (left-right direction in FIG. 7). In a state in which insertion into the through hole 42 is completed by the stopping protrusions 30 of the press-fit terminal 10 abutting against a surface 44 of the printed circuit board 40, the pressure contact parts 16 constituted in the lengthwise central portions of the first elastic pressure contact piece 24*a* and the second elastic pressure contact piece 24*b* of the press-fit terminal 10 are then pressure contacted to the inner surface of the through hole 42 by an elastic restoring force that is based on the elastic deformation at the time of insertion into the through hole 42, as shown in FIG. 7. That is, the first elastic pressure contact piece 24*a* and the second elastic pressure contact piece 24*b* of the press-fit terminal 10 are press fixed to the through hole 42. The press-fit terminal 10 is thereby electrically connected through pressure contact to a conductor, which is not illustrated, provided on the inner surface of the through hole 42 via the pressure contact parts 16 provided in the first elastic pressure contact piece 24*a* and the second elastic pressure contact piece 24*b*. Note that this conductor is connected to printed wiring, which is not illustrated, formed on the printed circuit board 40. Also, in order to facilitate understanding, the inner surface of the through hole 42 and the pressure contact parts 16 are show in a state of being slightly apart from each other in FIG. 7.

Figure 8:
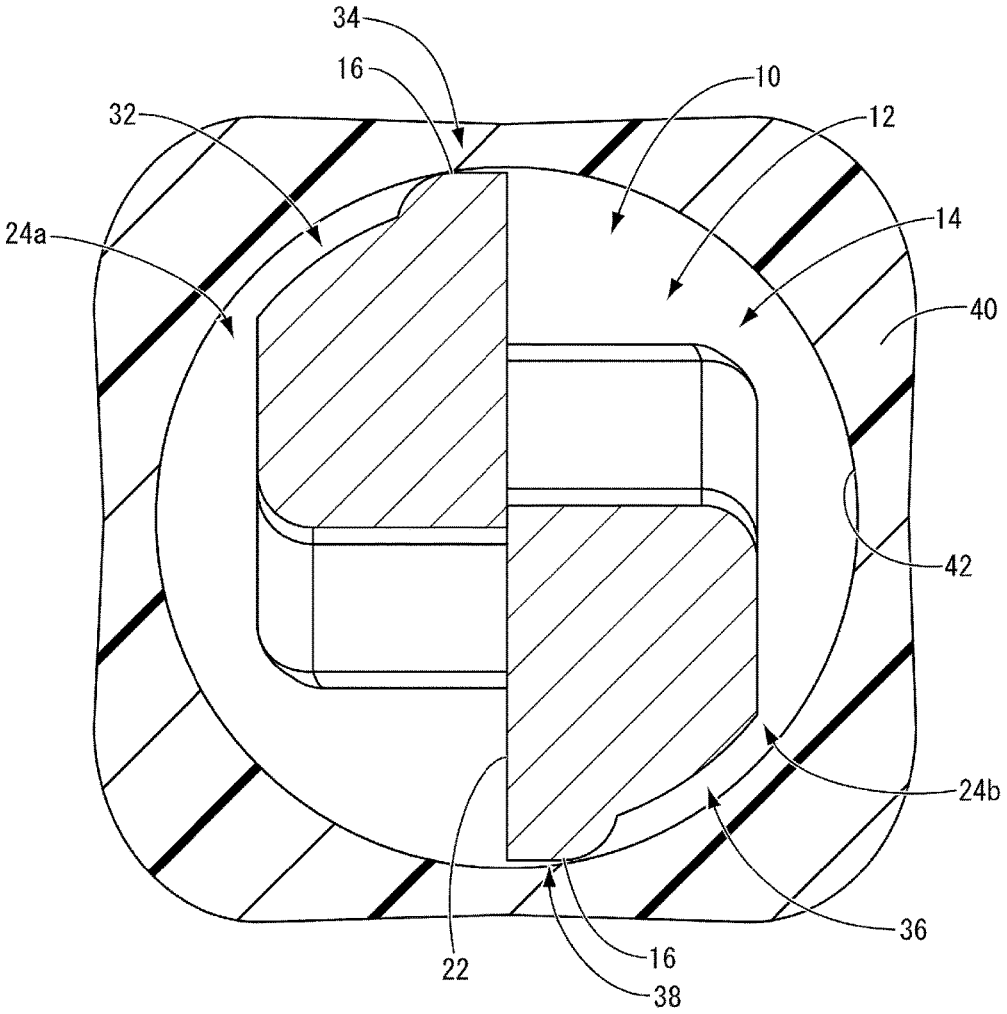
FIG. 8 is an enlarged cross-sectional view along VIII-VIII in FIG. 6.

More specifically, in a state in which the first elastic pressure contact piece 24*a* and the second elastic pressure contact piece 24*b* of the press-fit terminal 10 are press-fitted in the through hole 42, the press-fit terminal 10 is connected through pressure contact to the conductor, which is not illustrated, provided on the inner surface of the through hole 42, in regions, of the outer peripheral surfaces of the first raised part 34 and the second raised part 38 constituting the pressure contact parts 16, that are located apart from the first/second pressing parts 32 and 36 and the slit 22, as shown in FIG. 8.

Figure 5:
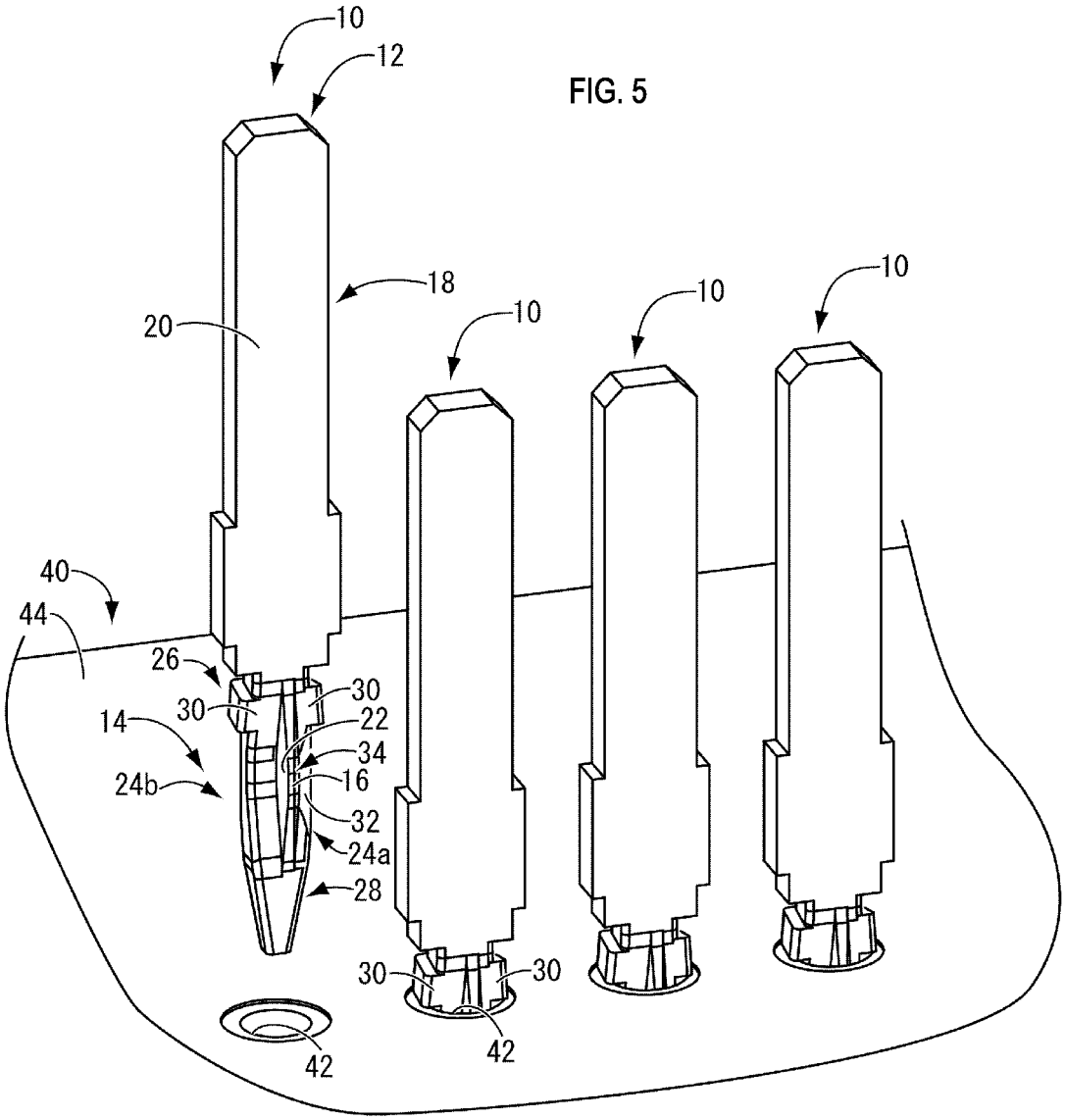
FIG. 5 is a perspective view showing a state in which press-fit terminals of the embodiment are installed in an upright manner on a printed circuit board.
Figure 6:
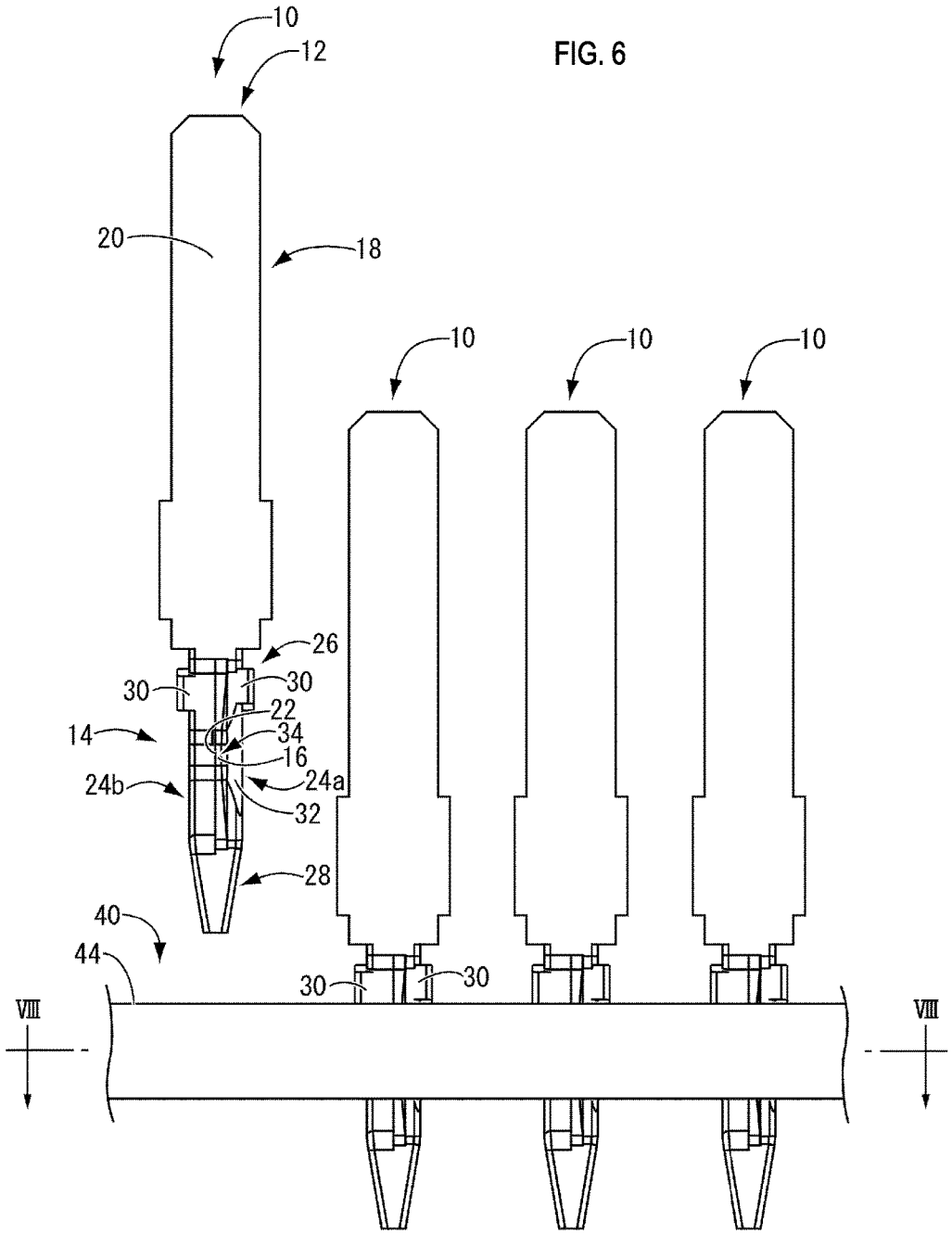
FIG. 6 is a front view of FIG. 5.

In addition, in a state in which the press-fit terminal 10 is mounted on the printed circuit board 40 after insertion into the through hole 42, the stopping protrusions 30 provided on the outer peripheral surfaces on the base end part 26 side of the first elastic pressure contact piece 24*a* and the second elastic pressure contact piece 24*b* will be abutted against the surface 44 of the printed circuit board 40, as shown in FIG. 5. That is, the amount by which the press-fit terminal 10 is pushed into the through hole 42 is determined by the stopping protrusions 30 abutting against the surface 44 of the printed circuit board 40.

Next, a manufacturing method for the press-fit terminal 10 that can be favorably used in manufacturing such a press-fit terminal 10 will be described, with reference to FIG. 9 to FIG. 12.

Figure 9:
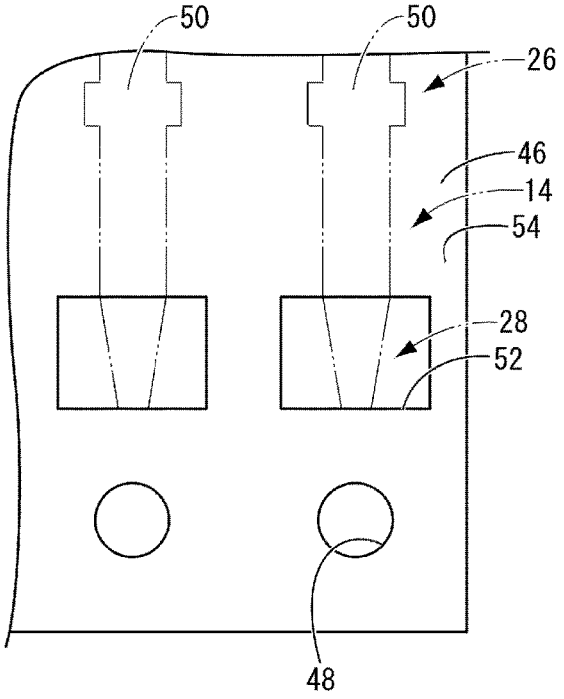
FIG. 9 is a plan view for illustrating a manufacturing method for the press-fit terminal of the embodiment, and shows the result of a process of flattening a formation target part of the tip of an elastic pressure contact piece.

First, for example, a metal plate 46 such as a copper plate whose surface has been plated in advance with tin or the like is prepared. An open hole 48 for positioning in and conveyance to a processing device is provided in this metal plate 46. A recessed part 52 that has a substantially rectangular shape in plan view is then formed, by performing a flattening process on a tip part 28 of a terminal fitting cutout target part 50 of the metal plate 46, as shown in FIG. 9. This recessed part 52 is formed such that a depth dimension gradually increases toward the tip side (downward in FIG. 9), making it possible to advantageously realize a tip part 28 having a tapered shape with a narrow tip in a terminal fitting cutout process which will be discussed later. Note that, in FIGS. 9 to 12, the terminal fitting cutout target part 50 and a slit formation target part 58 which will be discussed later are indicated with virtual lines.

Figure 10A:
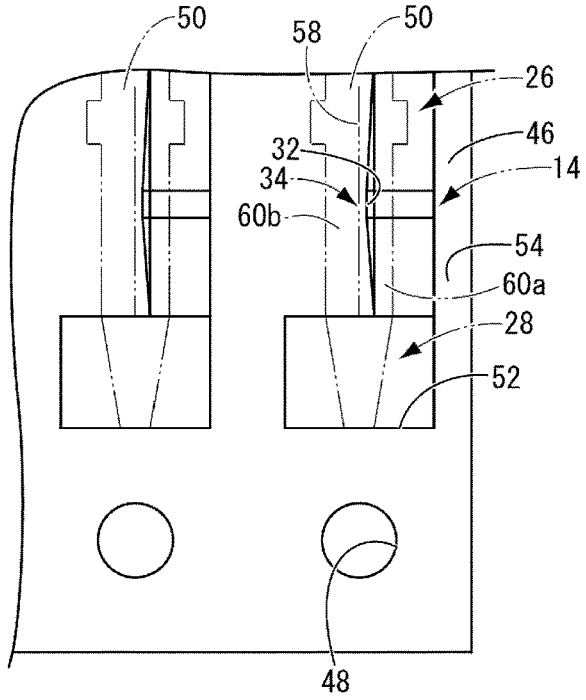
FIG. 10(*a*) is a plan view for illustrating a manufacturing method for the press-fit terminal of the embodiment.
Figure 10B:
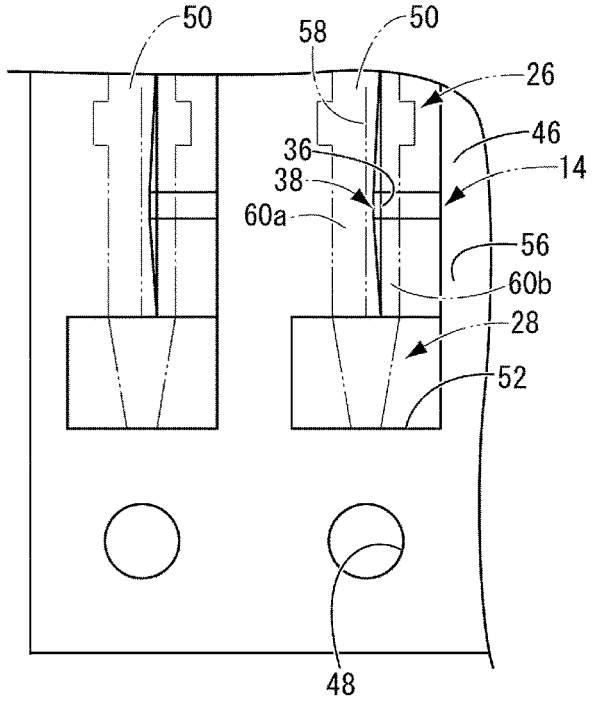

Next, as shown in FIG. 10, a pressing part/raised part formation process of forming a pressing part and a raised part is implemented, by performing a flattening process on both sides ((a) front surface 54, (b) back surface 56) of the metal plate 46. More specifically, in a lengthwise central portion on one end side 14 of the terminal fitting cutout target part 50 from which the terminal fitting 12 is to be cut out in the metal plate 46, a central portion of the terminal fitting cutout target part 50 in the plate width direction (left-right direction in FIG. 10) is the slit formation target part 58, and both sides in the plate width direction that sandwich the slit formation target part 58 therebetween are respectively a first elastic pressure contact piece formation target part 60*a* and a second elastic pressure contact piece formation target part 60*b*.

A first pressing part 32 constituting a recessed part that is substantially strip-shaped in plan view and obtained by flattening a lateral edge part side located apart from the slit formation target part 58 in the plate width direction of the first elastic pressure contact piece formation target part 60*a* is then provided in a lengthwise central portion of the first elastic pressure contact piece formation target part 60*a* on the front surface 54, which is one surface in the plate thickness direction (direction perpendicular to the page in FIG. 10), as shown in (a) of FIG. 10. This recessed part has a substantially half conical shape formed such that the depth dimension of the lengthwise central portion in a region approaching the slit formation target part 58 is largest. A first pressing part/raised part formation process that enables a first raised part 34 that is raised due to the first pressing part 32 to be provided at a position between the slit formation target part 58 and the first pressing part 32 is thereby implemented. Similarly, a second pressing part 36 constituting a recessed part that is substantially strip-shaped in plan view and obtained by flattening a lateral edge part side located apart from the slit formation target part 58 in the plate width direction of the second elastic pressure contact piece formation target part 60*b* is provided in a lengthwise central portion of the second elastic pressure contact piece formation target part 60*b* on the back surface 56, which is the other surface in the plate thickness direction (direction perpendicular to the page in FIG. 10), as shown in (b) of FIG. 10. This recessed part has a substantially half conical shape formed such that the depth dimension of the lengthwise central portion in a region approaching the slit formation target part 58 is largest. A second pressing part/raised part formation process that enables a second raised part 38 that is raised due to the second pressing part 36 to be provided at a position between the slit formation target part 58 and the second pressing part 36 is thereby implemented.

Figure 11:
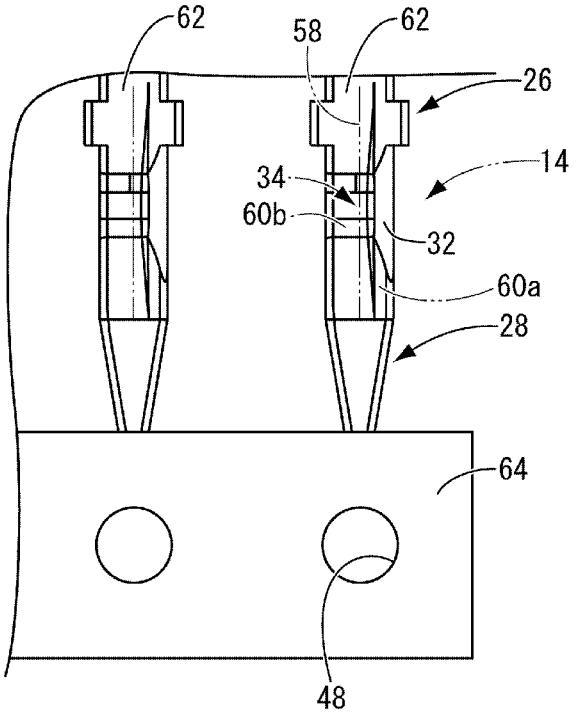
FIG. 11 is a plan view for illustrating a manufacturing method for the press-fit terminal of the embodiment, and shows the result of a terminal fitting cutout process.

Next, by implementing a terminal fitting cutout process such as a press punching process after the first pressing part/raised part formation process and the second pressing part/raised part formation process, a plate-like member 62 constituting the terminal fitting 12 is cut out from the terminal fitting cutout target part 50 of the metal plate 46, as shown in FIG. 11. As a result of the above, a large number of plate-like members 62 are formed every given distance in a state in which the tip part 28 is coupled to a throwaway plate part 64.

Figure 12A:
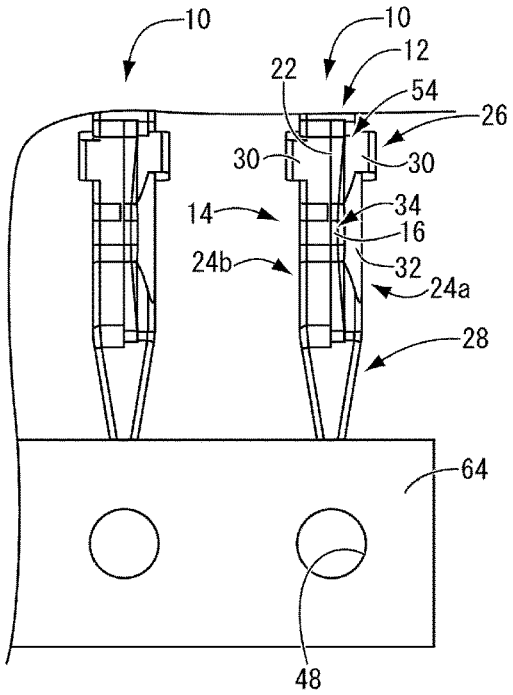
FIG. 12(*a*) is a plan view for illustrating a manufacturing method for the press-fit terminal of the embodiment.
Figure 12B:
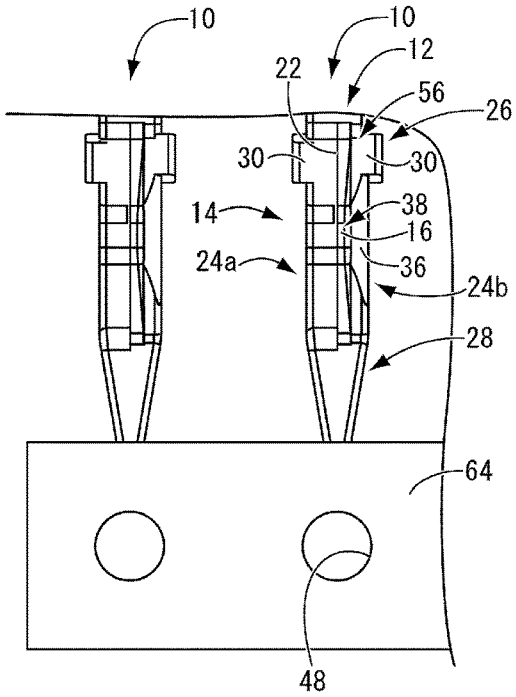

Finally, as shown in FIG. 11 and FIG. 12, a slit 22 that passes through in the plate thickness direction is formed in the slit formation target part 58 of the cutout plate-like member 62 constituting the cut out terminal fitting 12, as well as a first elastic pressure contact piece 24*a* being formed by deforming a lengthwise central portion of the first elastic pressure contact piece formation target part 60*a* to project on the front surface 54 side, which is one side of the plate-like member 62 constituting the terminal fitting 12 in the plate thickness direction (see (a) of FIG. 12), and a second elastic pressure contact piece 24*b* being formed by deforming a lengthwise central portion of the second elastic pressure contact piece formation target part 60*b* to project on the back surface 56 side, which is the other side of the plate-like member 62 constituting the terminal fitting 12 in the plate thickness direction (see (b) of FIG. 12). As a result of the above, the pressure contact part 16 of the first elastic pressure contact piece 24*a* is constituted by the first raised part 34 (see (a) of FIG. 12), and the pressure contact part 16 of the second elastic pressure contact piece 24*b* is constituted by the second raised part 38 (see (b) of FIG. 12). A slit and elastic pressure contact piece formation process is thus implemented, and the press-fit terminal 10 of the present embodiment is constituted. Individual press-fit terminals 10 can be obtained, by cutting the tip parts 28 of the press-fit terminals 10 away from the throwaway plate part 64.

According to the manufacturing method of the present embodiment, the first raised part 34 and the second raised part 38 that constitute the pressure contact parts 16 are formed with the first pressing part/raised part formation process and the second pressing part/raised part formation process, and the slit 22 is formed in a different portion from the first raised part 34 and the second raised part 38 with the slit and elastic pressure contact piece formation process which is different from these processes. Hence, it is possible to adopt a configuration that is able to advantageously avoid damage caused to the surface plating in the slit formation process extending to the surface plating of the first raised part 34 and the second raised part 38 that constitute the pressure contact parts 16. More specifically, given that the first raised part 34 and the second raised part 38 that constitute the pressure contact parts 16 are formed by the first pressing part 32 and the second pressing part 36 formed using the flattening process, and the first raised part 34 and the second raised part 38 are not directly subjected to a flattening process or the like, damage to the surface plating of the pressure contact parts 16 due to a flattening process or the like is advantageously avoided. Moreover, given that the slit 22 is provided in the slit formation target part 58 located apart from the first raised part 34 and the second raised part 38 that constitute the pressure contact parts 16 in the plate width direction, the surface plating of the pressure contact parts 16 being adversely affected by the slit formation process is also advantageously avoided. In addition, given that the first raised part 34 and the second raised part 38 that constitute the pressure contact parts 16 are provided at positions that sandwich the first pressing part 32 and the second pressing part 36 therebetween and are located apart from edge parts on both sides in the plate width direction of the terminal fitting 12 cut off using a press punching process or similar terminal fitting cutout process, damage to the surface plating due to the press punching process or similar terminal fitting cutout process is also advantageously avoided. Given that the surface plating of the pressure contact parts 16 can thus be maintained in an excellent state without any damage or the like, the stability of the electrical connection with the conductor inside the through hole 42 can be stably secured, and the need for post-plating on the pressure contact parts 16 can also be more reliably eliminated.

Also, according to the press-fit terminal 10 obtained by such a manufacturing method, given that the first raised part 34 and the second raised part 38 that constitute the pressure contact parts 16 have a curved outer peripheral shape, excessive contact resistance with the inner surface of the through hole 42 at the time of press-fitting the press-fit terminal 10 into the through hole 42 is suppressed, in addition to the abovementioned effects. Hence, given that peeling or damage to the surface plating of the first raised part 34 and the second raised part 38 can be further reduced, a stable connection state can be advantageously maintained.

Although an embodiment of the present invention was described above in detail, the present invention is not limited by the above specific description. For example, in the above embodiment, lengthwise central portions of the first elastic pressure contact piece 24*a* and the second elastic pressure contact piece 24*b* were deformed so as to project on both sides (both the right and left sides in FIG. 4) in the plate thickness direction of the terminal fitting 12 and formed to overlap in side view (see FIG. 4), but may be formed so as to not overlap in side view.

What is claimed is:

1. A press-fit terminal in which a pressure contact part configured to be press-fitted into a through hole of a printed circuit board and connected through pressure contact to a conductor on an inside surface of the through hole is provided on one end side of a terminal fitting cut out from a metal plate that has been surface plated in advance, and in which a slit that passes through a central portion in a plate width direction of the terminal fitting and a first elastic pressure contact piece and a second elastic pressure contact piece that are separated on both sides in the plate width direction by the slit are provided in a lengthwise central portion on the one end side of the terminal fitting, a lengthwise central portion of the first elastic pressure contact piece being deformed to project on one side in a plate thickness direction of the terminal fitting and a lengthwise central portion of the second elastic pressure contact piece being deformed to project on an other side in the plate thickness direction of the terminal fitting, the press-fit terminal comprising:

in the lengthwise central portion of the first elastic pressure contact piece, a first pressing part that is provided on a lateral edge part side located apart from the slit in a plate width direction of the first elastic pressure contact piece and a first raised part that is located between the slit and the first pressing part and projects further on the one side in the plate thickness direction than the first pressing part, the pressure contact part of the first elastic pressure contact piece being constituted by the first raised part; and in the lengthwise central portion of the second elastic pressure contact piece, a second pressing part that is provided on a lateral edge part side located apart from the slit in a plate width direction of the second elastic pressure contact piece and a second raised part that is located between the slit and the second pressing part and projects further on the other side in the plate thickness direction than the second pressing part, the pressure contact part of the second elastic pressure contact piece being constituted by the second raised part, wherein the first raised part and the second raised part have a curved outer peripheral shape extending along a longitudinal length of the pressure contact part.

2. A manufacturing method for a press-fit terminal in which a pressure contact part configured to be press-fitted into a through hole of a printed circuit board and connected through pressure contact to a conductor of an inner surface of the through hole is provided on one end side of a terminal fitting, the method comprising:

a first pressing part/raised part formation step of, where in a lengthwise central portion on one end side of a terminal fitting cutout target part from which the terminal fitting is to be cut out in a metal plate that has been surface plated in advance, a central portion in a plate width direction of the terminal fitting cutout target part is a slit formation target part, and both sides in the plate width direction that sandwich the slit formation target part therebetween are respectively a first elastic pressure contact piece formation target part and a second elastic pressure contact piece formation target part, providing, in a lengthwise central portion of the first elastic pressure contact piece formation target part on one surface in a plate thickness direction, a first pressing part by flattening a lateral edge part side located apart from the slit formation target part in a plate width direction of the first elastic pressure contact piece formation target part, and a first raised part that is raised due to the first pressing part to be located between the slit formation target part and the first pressing part;

a second pressing part/raised part formation step of providing, in a lengthwise central portion of the second elastic pressure contact piece formation target part on an other surface in the plate thickness direction, a second pressing part by flattening a lateral edge part side located apart from the slit formation target part in a plate width direction of the second elastic pressure contact piece formation target part, and a second raised part that is raised due to the second pressing part to be located between the slit formation target part and the second pressing part;

a terminal fitting cutout step of cutting out the terminal fitting from the terminal fitting cutout target part in the metal plate, after the first pressing part/raised part formation step and the second pressing part/raised part formation step; and a slit and elastic pressure contact piece formation step of forming, in the slit formation target part of the cut out terminal fitting, a slit that passes through in the plate thickness direction, forming the first elastic pressure contact piece by deforming a lengthwise central portion of the first elastic pressure contact piece formation target part to project on one side of the terminal fitting in the plate thickness direction and constituting the pressure contact part of the first elastic pressure contact piece by the first raised part, and forming the second elastic pressure contact piece by deforming a lengthwise central portion of the second elastic pressure contact piece formation target part to project on an other side of the terminal fitting in the plate thickness direction and constituting the pressure contact part of the second elastic pressure contact piece by the second raised part, wherein the first raised part and the second raised part have a curved outer peripheral shape extending along a longitudinal length of the pressure contact part.

* * * * *